US005078199A

United States Patent [19]

Hannerstig

[11] Patent Number: 5,078,199

[45] Date of Patent: Jan. 7, 1992

[54] ASSEMBLY FOR DRAPING CURTAINS

[75] Inventor: Christer Hannerstig, Höllviksnäs, Sweden

[73] Assignee: AB A Svennsson & Co., Malmö, Sweden

[21] Appl. No.: 640,936

[22] Filed: Jan. 14, 1991

Related U.S. Application Data

[63] Continuation of Ser. No. 554,454, Jul. 19, 1990, abandoned, which is a continuation of Ser. No. 370,340, Jun. 22, 1989, Pat. No. 4,958,646, which is a continuation of Ser. No. 114,655, Oct. 28, 1987, abandoned.

[30] Foreign Application Priority Data

Oct. 29, 1986 [DE] Fed. Rep. of Germany ..... 3636845
Oct. 12, 1987 [EP] European Pat. Off. ..... 87114878.9

[51] Int. Cl.[5] ..... A47H 13/14
[52] U.S. Cl. ..... 160/348; 160/349.2
[58] Field of Search ..... 160/348, 349.1, 349.2, 160/405; 248/251, 252, 261, 262; D6/578; D8/354, 368, 369, 370, 371

[56] References Cited

U.S. PATENT DOCUMENTS

D. 120,628 5/1940 Jembrzycki .
D. 286,261 10/1986 Smederöd .
D. 290,931 7/1987 Powell .
247,860 10/1881 Warner .
361,007 4/1887 Gould .
464,499 12/1891 Grenelle .
744,691 11/1903 Porter .
827,000 7/1906 Dinsmore .
1,037,074 9/1913 Jones .
1,134,533 4/1915 Holland .
1,530,180 3/1925 Holmes .
1,637,704 8/1927 Moats .
1,644,105 10/1927 Boye .
1,730,979 10/1929 Leibchen .

(List continued on next page.)

FOREIGN PATENT DOCUMENTS 187246 10/1918 Canada .
236021 11/1927 Canada .

(List continued on next page.)

OTHER PUBLICATIONS

Dreyfuss Symbol Source Book, 1972, p. 89 "Summer Symbol".
"Plastic Push-Pin Tiebacks," Dated Approximately 1943.
"Wood Festoon Ornament," Dated 1941.
"Plastic Holdbacks and Festoon Rings", Dated 1943.

*Primary Examiner*—David M. Purol

[57] ABSTRACT

A drapery holder for securing to a wall surface for retaining drapery material adjacent to a window or wall opening includes a wall engaging member disposed in a first plane. A first leg has a first end disposed adjacent to the wall engaging member and a second end extends from the first end and projects outwardly in a second plane substantially orthogonally to the wall engaging member. A curved member is disposed adjacent to the second end of the first leg. The curved member projects from the second plane in a path curving in a reverse direction back towards the wall engaging member. The second leg includes a first end disposed adjacent to the curved member and a second end projecting rearwardly towards the wall engaging member. The second leg is disposed in a third plane substantially orthogonally disposed relative to the wall engaging member and is substantially in parallel with the second plane. The first leg, the second leg and the wall engaging member are aligned relative to each other and define an opening between the first and second legs for accommodating drapery material therebetween. The opening is disposed to permit drapery material to be supported by the second leg and pass through the opening to be also supported by the first leg.

10 Claims, 6 Drawing Sheets

U.S. PATENT DOCUMENTS 1,741,182 12/1929 Boye .
1,817,962 8/1931 Breuer .
1,836,018 12/1931 Dover .
1,874,813 8/1932 Saunders .
1,876,026 9/1932 Schinkal .
1,980,918 11/1934 Hudspeth .
2,244,129 6/1941 Stratton .
2,431,934 12/1947 Higgins .
2,459,503 1/1949 Dahlstrom et al. .
2,480,360 8/1949 Doty .
2,588,246 3/1952 Kenney .
2,606,733 8/1952 Krajewski .
2,607,412 8/1952 Vance et al. .
2,637,384 5/1953 McCabe .
2,909,354 10/1959 Bingham .
3,104,086 9/1963 Salzmann .
3,203,469 8/1965 Falkenberg .
3,317,167 5/1967 Becker et al. .
3,417,807 12/1968 Falkenberg .
3,545,523 12/1970 Falkenberg .
3,901,303 8/1975 Falkenberg .
4,284,258 8/1981 Kleiman .
4,912,829 4/1990 Hickey ..... 160/349.2 X
4,958,646 9/1990 Hannershg ..... 160/349.2 X
8,516,678 4/1990 Levy .

FOREIGN PATENT DOCUMENTS 464275 4/1950 Canada .
449312 9/1927 Fed. Rep. of Germany .
8337252 4/1984 Fed. Rep. of Germany .
1214456 4/1960 France .
20736 4/1928 United Kingdom .
473669 11/1937 United Kingdom .
785300 10/1957 United Kingdom .
1278118 6/1972 United Kingdom .

ASSEMBLY FOR DRAPING CURTAINS

CROSS-REFERENCE TO RELATED APPLICATIONS

The present application is a continuation of U.S. Ser. No. 07/554,454, filed July 19, 1990, now abandoned, which is a continuation of U.S. Ser. No. 07/370,340, filed on June 22, 1989, now U.S. Pat. No. 4,958,646, which is a continuation of U.S. Ser. No. 114,655, filed on Oct. 28, 1987, now abandoned.

BACKGROUND OF THE INVENTION

The present invention is directed to an assembly for draping curtains or the like.

When draping a window curtain or a portiere, the curtain material is plaited or folded to form a bar-like bundle (zigzag or meander plaiting) and is placed over two supporting rods which are mounted in horizontally spaced relationship above the window or door. To form a draping arc between the two supporting rods, the lower portion of the curtain material is thereafter pulled down to form circular-segment-type folds. It is extremely difficult and requires a corresponding degree of skill to keep the upper-most fold or folds taut between the two supporting rods.

It is the object of the present invention to modify the above-mentioned supporting rods in such a way that during the forming of a draping arc the uppermost folds are always kept taut in an operation that does not require any special skill.

SUMMARY OF THE INVENTION

The above-specified object is solved in a surprisingly simple way by using the holders described below.

When the holders of the present invention are used, it is extremely simple even for an unskilled person to form a draping arc between two horizontally spaced holders. There is no risk of the uppermost folds being pulled down while the draping arc is formed so that the curtain would actually "sag" between the two holders. Also the operation does not require two or more persons, which is normally the case when draping a curtain or the like in accordance with the conventional technique, particularly when larger draping arcs or greater distances between the curtain holders are concerned.

It is preferred that the holder in accordance with the present invention is made from a flat bar section, and in one embodiment from flat iron bent to U-shape, wherein the upper leg when in the mounted state is shorter than the lower leg through which the holder can be secured to an upright wall or the like. This embodiment is a particularly simple design which can be manufactured with corresponding economy.

When it is desired to provide two or more draping arcs between two outermost holders according to the present invention, one or more intermediate hook-like holders are provided which can respectively be secured to an upright wall in spaced relationship therefrom. Finally, another embodiment of a draping holder permits the formation of fabric rosettes at the supporting or holding locations of the curtain or curtain material. These holders are in fact ornamental holders.

BRIEF DESCRIPTION OF THE DRAWINGS

Below, a preferred embodiment of the assembly according to the invention will be explained in detail with reference to the accompanying drawing, in which.

DESCRIPTION OF THE PREFERRED EMBODIMENTS

Figure 1:
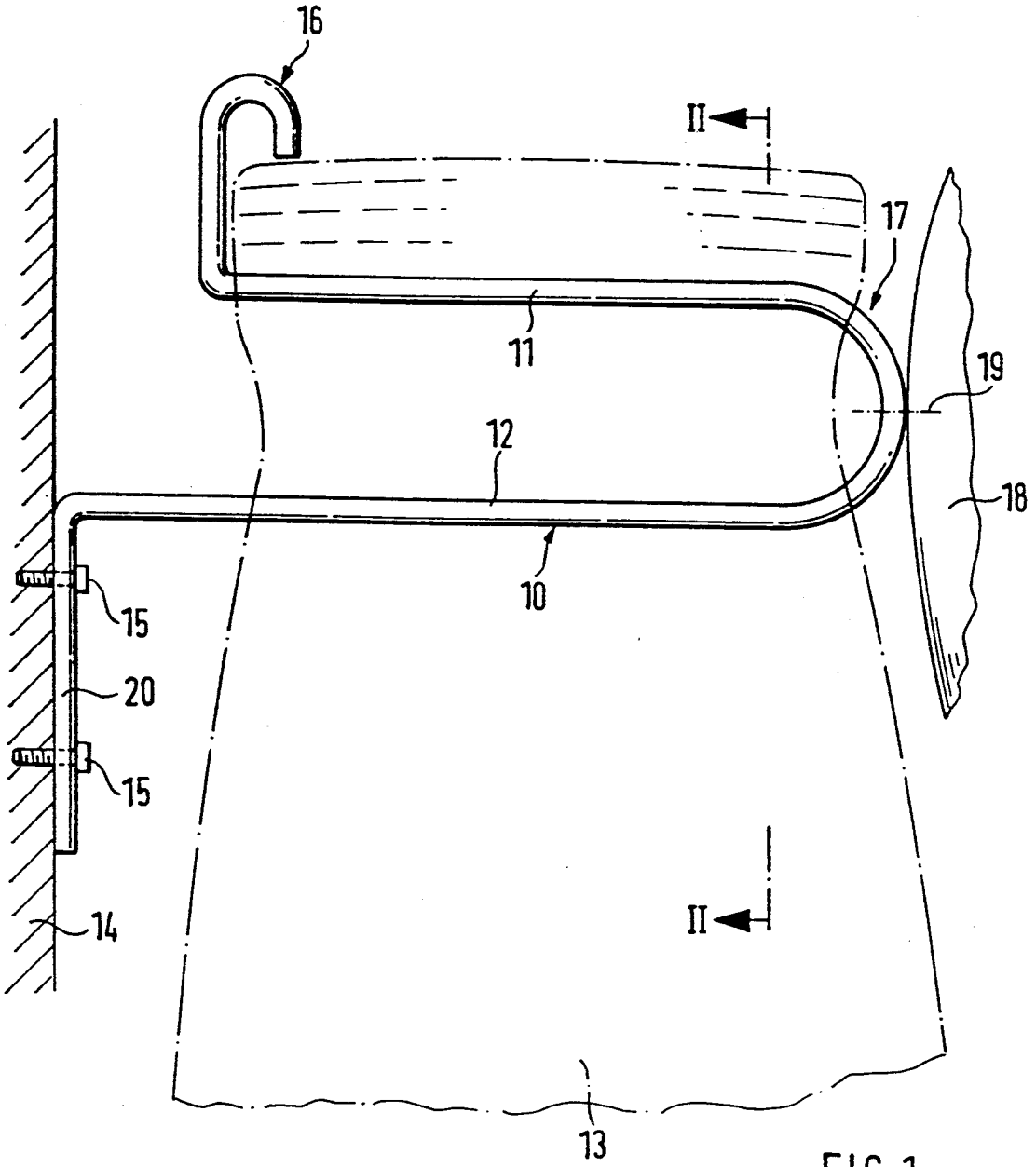
FIG. 1 is a side view of a draping holder of the present invention.
Figure 2:
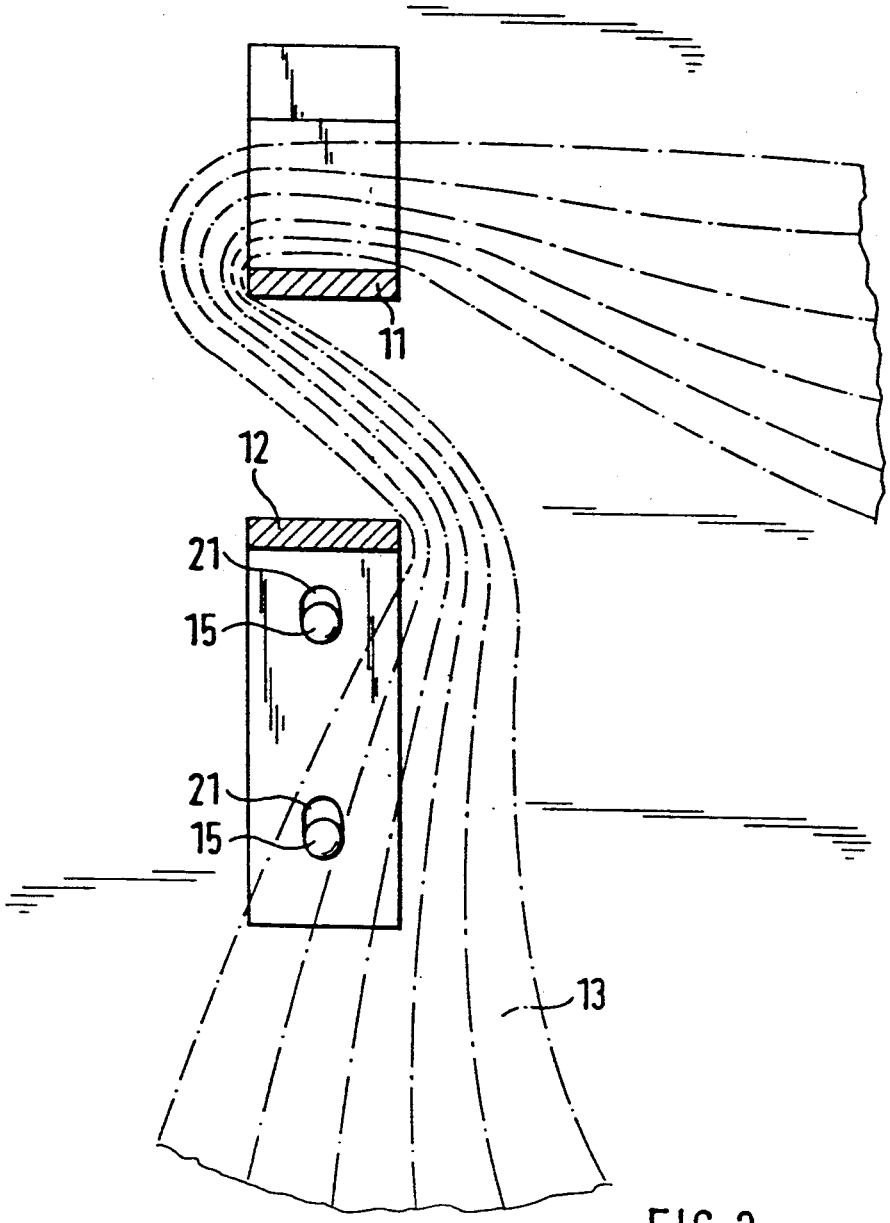
FIG. 2 is a section along the line II—II of FIG. 1 showing the draping holder of FIG. 1.

The assembly according to the present invention for draping curtains or the like features at least one, especially two horizontally spaced holder 10 bent to U-shape over whose respective legs 11, which in the mounted state form the upper legs. A curtain material 13 folded to form a bar-like bundle is placed and is subsequently passed from the outside to the inside between the upper and the lower legs of the mentioned holders such that the curtain material is retained on the holders 10 while the desired draping is maintained. In FIGS. 1 and 2, the lower leg of the holder 10 of the present invention is referenced 12.

The U-shaped holder 10 is bent from a flat bar section, i.e., coated flat iron, and the upper leg 11 in the mounted state is somewhat shorter than the lower leg 12 through which the holder 10 may be secured to an upright wall 14 (fastening screws 15).

At its free end, i.e., the end presented to the wall 14, the upper leg 11 when in the mounted state is initially bent upwards and subsequently bent forwardly downwards to form an open-bottomed C- or U-shaped terminal portion 16 which actually fixes the curtain material placed over the upper leg 11 (see FIG. 1).

The inward terminal portion 16 of the upper leg 11 has a dual function as lateral and upper limiting means with a gripping effect on the curtain material placed over the upper leg 11; of course, this is true under the condition that the curtain material draped to form a bar-like bundle has a height in excess of the distance between the lower end of the terminal portion 16 and the top of the upper leg 11. In order to ensure this feature, said distance is preferably about 5 to 10 mm, especially about 6 to 7 mm.

In the vicinity of the U-bend 17 of the holder 10 there is likewise provided an outer limiting means for the curtain material 13 placed over the upper leg 11. This limiting means projects beyond the top of the upper leg 11 and is configured as a rosette 18 Which overlaps the U-bend 17 of the holder 10 both upwardly and downwardly. The rosette 18 is secured in the vicinity of the U-bend 17 of the holder 10 by means of a screw 19 which is indicated in FIG. 1. Instead thereof, a rivet joint, an adhesive joint or a solder joint would also be conceivable.

The free end of the lower leg 12 of the U-shaped holder 10 is bent downward to form a lug-like connecting member 20 through which the holder 10 can be mounted on the wall 14 by means of fastening screws 15 which are disposed above one another in spaced relationship To this end the connecting member 20 is formed with through-holes 21 (see FIG. 2). As illustrated in FIG. 2, the holes 21 are elongated holes so that during assembly the holders 10 can be slightly shifted up and down for elevational adjustment with a similar holder mounted in horizontally spaced relationship.

A further intermediate leg, which is not illustrated in the present embodiment, may also be provided between the upper leg 11 and the lower leg 12. Such intermediate leg extends approximately in parallel with the upper and the lower legs, so that the curtain material 13 which is draped to form a bar-like bundle can be passed between upper leg 11 and intermediate leg, and then passed between the intermediate leg and lower leg 12.

It should be noted that the upper leg 11 is shorter than the lower leg 12 of the holder 10 to facilitate the introduction of the curtain material, which has been draped to a bar or board-like bundle, into the region between upper and lower leg through the gap between the upright wall 14 or the like and the free inner end of the upper leg 11. The draped curtain material 13 is actually "threaded" through said gap into the region between the upper and lower leg of the holder 10. This "threading" is additionally facilitated by the described configuration of the wall-side terminal portion 16 of the upper leg 11. There is no risk of the "threaded" curtain material 13 being caught. The upper leg 11 is shorter than the lower leg 12 by an amount which preferably corresponds approximately to the inside spacing between upper and lower leg.

It is especially advantageous when the upper leg is slightly inclined in the direction towards its free end relative to the lower leg 12, the angle of inclination relative to the lower leg 12 being about 5 to 10 degrees. Thereby the retaining or clamping action between draped curtain material 13 and holder 10 is improved.

It should be noted that in FIGS. 1 and 2 the draped curtain material 13 is indicated in dashed lines for the sake of clarity.

Figure 4:
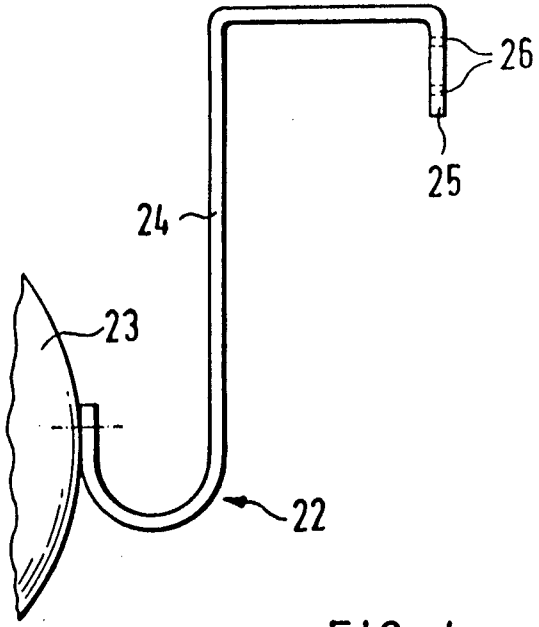
FIG. 4 is a side view of an intermediate hook drawn to reduced scale.

For the provision of two or more draping arcs between two outermost holders 10 of the described kind, one or several intermediate holders configured like a hook 22 are provided (see FIGS. 3 and 4), said hook being mounted in spaced relationship from an upright wall or the like.

Actually, the intermediate hook 22 is likewise bent from a flat bar section, preferably coated flat iron. The free end of the hook is covered by a front rosette 23 which is similar to the rosette 18 of the hook 10. For mounting the hook 22 in spaced relationship from the upright wall, the wall-side leg 24 of the hook 22 is twice bent by 90 degrees to form a connecting member 25 parallel with the wall, said connecting member being formed with at least two holes 26 above one another for the passage of fastening screws or means to attach the connecting member to the wall.

Figure 3:
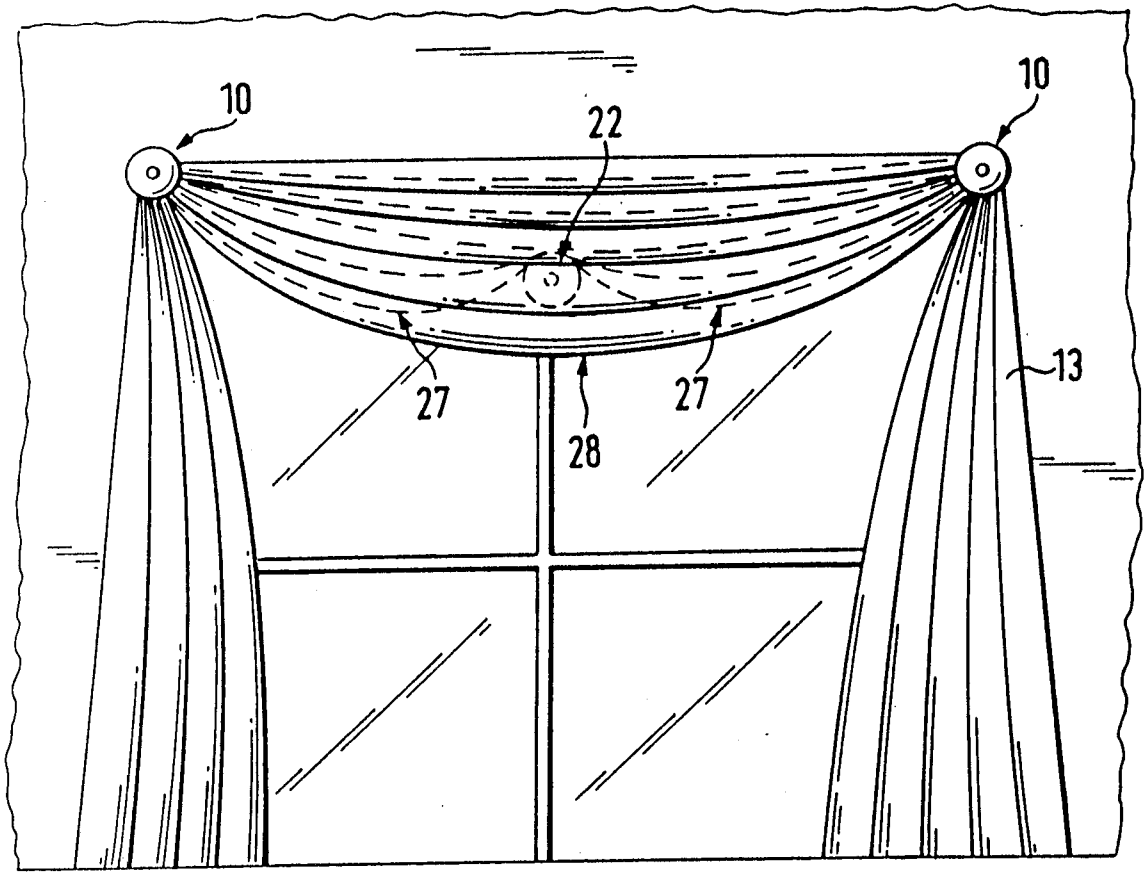
FIG. 3 is the assembly of the draping holders according to the present invention above a window, illustrating a draping arc formed between these two holders and showing (in dashed lines) an intermediate hook disposed between the two outer draping holders for providing two draping arcs.

FIG. 3 indicates in dashed lines a possible position of the intermediate hook 22 relative to the two outermost holders 10 to form two draping arcs 27. When the intermediate hook 22 is omitted, only a single draping arc 28 can be formed between the two outermost holders 10.

The intermediate hook 22 may also be configured as a loose U-bracket which is open-topped in the mounted state, the forward leg again being covered by a rosette 23 serving as a screen element.

With the described holders it is extremely easy for anyone to drape curtains by forming horizontal draping arcs and draped shawls which respectively depend from the holders 10 according to the present invention for framing the sides of a window or a door.

Figure 7:
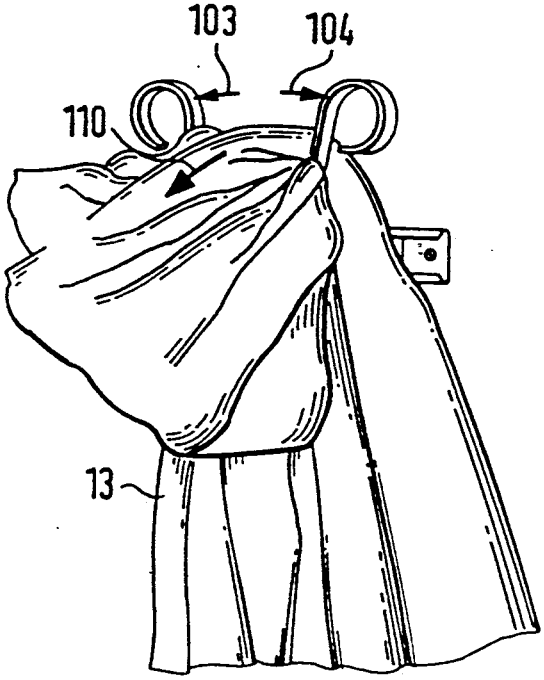
Figure 8:
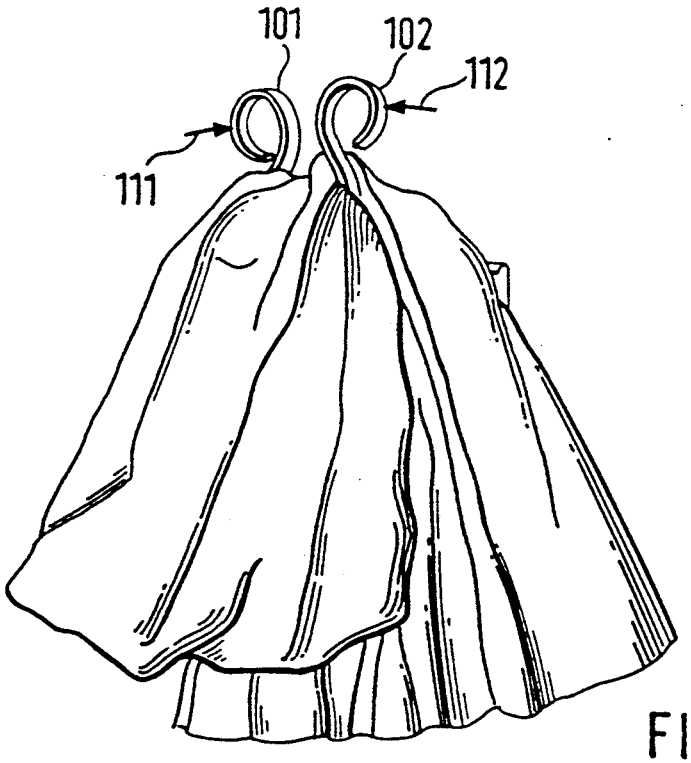
Figure 9:
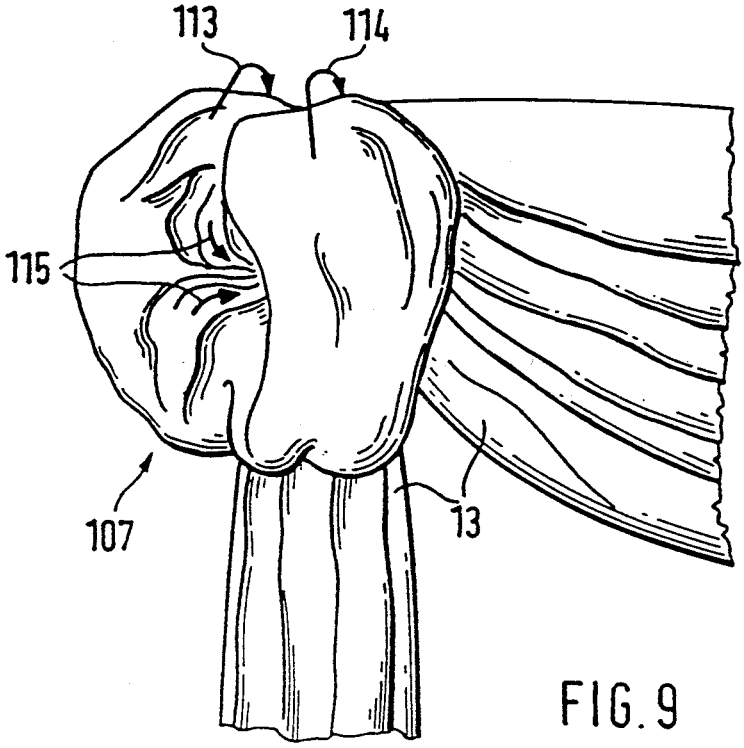
Figure 10:
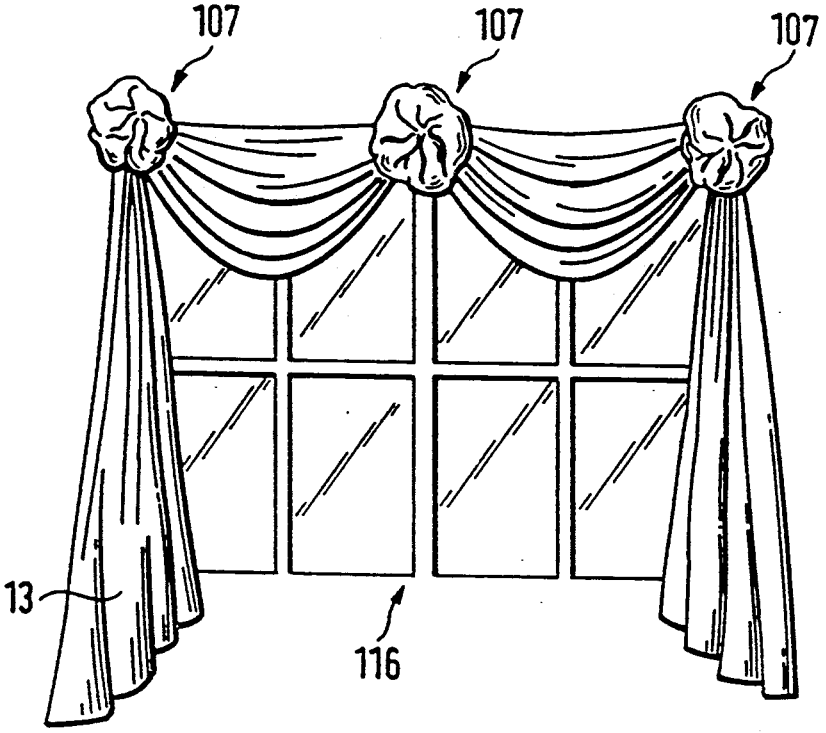
FIG. 10 shows a fully draped window curtain making use of three horizontally spaced draping hooks shown in FIG. 5 and mounted above the window.

FIGS. 5 to 10 illustrate a further embodiment of a draping holder 100 and the use thereof, whereby fabric rosettes 107 are formed in the vicinity of the holder and simultaneously cover the same (see FIGS. 9 and 10). Thus, the holder 100 is in fact a kind of ornamental hook.

Figure 6:
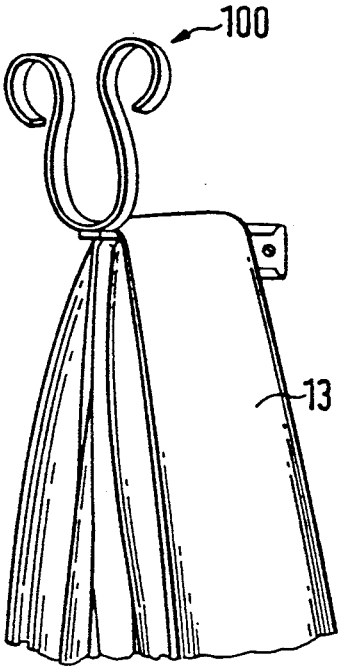
FIGS. 6–9 are perspective views respectively illustrating the draping of a curtain by using a holder as shown in FIG. 5.

The holder 100 is made from metallic flat bar material or the like and bent to approximate U- or C-shape. It is mounted in spaced relationship from a wall 14 via an L-bracket 105 secured to the wall (mounting plate 108 and fastening screws 109 in FIG. 5) such that the plane defined by the two prongs 101, 102 of the holder extends approximately in parallel with the wall 14 or the surface thereof, respectively. To provide the mentioned rosettes 107, the curtain material 13 is initially placed over the L-bracket 105 in meander-pleated configuration as illustrated in FIG. 6. Then an upper layer of curtain material is pulled forwards through the two prongs 101 and 102 as shown in FIG. 7 (see arrow 110 in FIG. 7), and during this operation the two prongs 101, 102 are resiliently spread apart (see arrows 103, 104 in FIG. 7). The curtain material is pulled forward between the two prongs 101 and 102 approximately as far as shown in FIG. 8. When this step has been completed the two prongs 101 and 102 will return to their initial positions as indicated by the arrows 111, 112.

Thereafter, the forwardly pulled portion of the curtain material 13 is turned back over and between the prongs 101, 102 (see arrows 113, 114, 115 in FIG. 9) to obtain the desired rosette 107.

Figure 5:
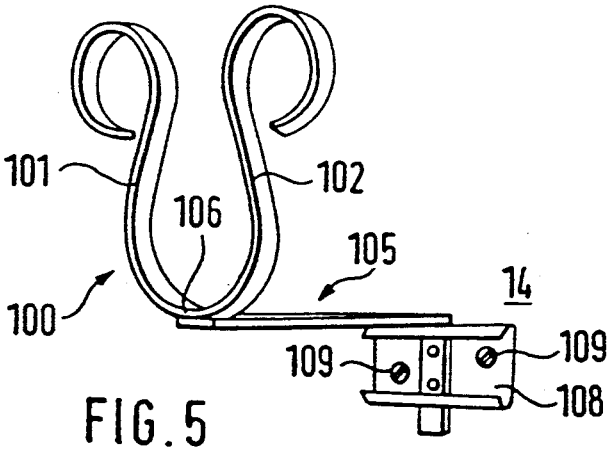
FIG. 5 is a perspective view showing a further embodiment of a draping holder according to the present invention.

FIG. 10 illustrates a curtain 13 fully draped around a window 116, wherein draping has been performed by the use of three horizontally spaced draping holders 100 shown in FIG. 5 and mounted above the window 116.

All of the features disclosed in the present documents are claimed as being essential to the invention to the extent to which they are novel over the prior art either individually or in combination.

What is claimed is:

1. A drapery holder adapted to be secured to a wall surface for retaining drapery material adjacent to a window or wall opening comprising:

a wall engaging member disposed in a first plane;

a first leg having a first end and a second end, said first end being disposed adjacent to said wall engaging member and said second end extending from said first end and projecting outwardly in a second plane substantially orthogonally disposed relative to said wall engaging member, said first leg forming a lower surface adapted for supporting drapery material thereon;

a curved member disposed adjacent to said second end of said first leg, said curved member projecting from said second plane in a path curving in a reverse direction back towards said wall engaging member;

a second leg having a first end and a second end, said first end being disposed adjacent to said curved member and said second end of said second leg projecting rearwardly towards said wall engaging member, said second leg being disposed in a third plane substantially orthogonally disposed relative to said wall engaging member and substantially in parallel with said second plane, said second leg forming an upper surface adapted for supporting drapery material thereon;

said second and third planes being spaced apart a predetermined distance relative to each other wherein said first leg, second leg and said wall engaging member are aligned relative to each other in said first plane and said first and second legs define an opening therebetween for accommodating drapery material, said opening being disposed to permit drapery material to be supported by said second leg positioned in said third plane and pass through said opening to be supported by said first leg positioned in said second plane.

2. The drapery holder according to claim 1, wherein said first leg, second leg and said wall engaging member are integrally formed.

3. The drapery holder according to claim 1, and further including apertures through said wall engaging member for positioning securing means for securing said drapery holder to a wall surface.

4. The drapery holder according to claim 1, wherein said first leg and said wall engaging member are bent in a substantially L-shape relative to each other.

5. The drapery holder according to claim 1, wherein said first leg, second leg and wall engaging member are constructed of a flat bar member and said second leg is shorter relative to said first leg.

6. The drapery holder according to claim 1, and further including a retainer member being disposed on said curved member for retaining drapery material on said second leg.

7. The drapery holder according to claim 6, wherein said retainer member is a circular plate.

8. The drapery holder according to claim 6, wherein said retainer member is a rosette.

9. The drapery holder according to claim 6, and further including a terminal portion disposed adjacent to said second end of said second leg for retaining drapery material on said second leg.

10. The drapery holder according to claim 9, wherein said terminal portion includes a section projecting upwardly from said second leg and a curved section bent downwardly in a reverse direction towards said second leg.

* * * * *